US011137146B2

(12) United States Patent
Bagwell et al.

(10) Patent No.: US 11,137,146 B2
(45) Date of Patent: Oct. 5, 2021

(54) OVEN EXHAUST HOOD METHODS, DEVICES, AND SYSTEMS

(71) Applicant: Oy Halton Group Ltd., Helsinki (FI)

(72) Inventors: Rick A. Bagwell, Scottsville, KY (US); Andrey V. Livchak, Bowling Green, KY (US); Derek W. Schrock, Bowling Green, KY (US)

(73) Assignee: OY HALTON GROUP LTD., Helsinki (FI)

( * ) Notice: Subject to any disclaimer, the term of this patent is extended or adjusted under 35 U.S.C. 154(b) by 176 days.

(21) Appl. No.: 16/259,027

(22) Filed: Jan. 28, 2019

(65) Prior Publication Data

US 2019/0212015 A1 Jul. 11, 2019

Related U.S. Application Data

(63) Continuation of application No. 15/260,590, filed on Sep. 9, 2016, which is a continuation of application No. 14/265,966, filed on Apr. 30, 2014, now Pat. No. 9,777,929, which is a continuation of application No. 13/761,412, filed on Feb. 7, 2013, now Pat. No. 9,134,036, which is a continuation of application No. 13/522,048, filed as application No.
(Continued)

(51) Int. Cl.
*F24C 15/20* (2006.01)
*F24C 7/08* (2006.01)

(52) U.S. Cl.
CPC ..... *F24C 15/2007* (2013.01); *F24C 7/08* (2013.01); *F24C 15/20* (2013.01); *F24C 15/2021* (2013.01); *F24C 15/2028* (2013.01); *F24C 15/2035* (2013.01); *F24C 15/2042* (2013.01)

(58) Field of Classification Search
CPC .. F24C 15/20; F24C 15/2042; F24C 15/2021; F24C 15/2007; F24C 15/322
USPC ..... 126/299 R, 21 A; 454/49, 340, 59
See application file for complete search history.

(56) References Cited

U.S. PATENT DOCUMENTS 2,868,108 A 1/1959 Petersen
3,032,028 A 5/1962 Pearce et al.
3,051,158 A 8/1962 Kimberley
(Continued)

FOREIGN PATENT DOCUMENTS

CN 1603692 A 4/2005
CN 102782415 B 6/2016
(Continued)

OTHER PUBLICATIONS

Clark, Design Considerations for Commercial Kitchen Ventilation, ASHRAE Journal, Feb. 2012, pp. 54-62.
(Continued)

*Primary Examiner* — Vivek K Shirsat
*Assistant Examiner* — Ko-Wei Lin
(74) *Attorney, Agent, or Firm* — Potomac Law Group, PLLC; George S. Dolina

(57) ABSTRACT

A method of controlling exhaust flow includes receiving at a digital controller at least one signal pertaining to a state of cooking appliance, controlling an exhaust flow to increase responsively to the at least one signal at a first time, and controlling the exhaust flow to decrease at a later time responsively to at least another signal indicating another state of the cooking appliance.

14 Claims, 6 Drawing Sheets

Related U.S. Application Data

PCT/US2011/021167 on Jan. 13, 2011, now abandoned.

(60) Provisional application No. 61/294,511, filed on Jan. 13, 2010.

(56) References Cited

U.S. PATENT DOCUMENTS

| | | | | |
|---|---|---|---|---|
| 3,233,606 | A | 2/1966 | Robert et al. | |
| 3,859,499 | A | 1/1975 | Evans et al. | |
| 3,924,601 | A | 12/1975 | Nuss | |
| 3,941,039 | A | 3/1976 | Kinney | |
| 4,066,064 | A | 1/1978 | Vandas | |
| 4,180,049 | A | 12/1979 | Carr et al. | |
| 4,406,277 | A | 9/1983 | Russo | |
| 4,592,333 | A | 6/1986 | Dustin | |
| 4,616,562 | A | 10/1986 | Kuechler | |
| 5,215,497 | A * | 6/1993 | Drees | B08B 15/023 454/61 |
| 5,421,320 | A | 6/1995 | Brown | |
| 5,577,490 | A | 11/1996 | Overton | |
| 5,941,235 | A | 8/1999 | Carter | |
| 6,111,240 | A * | 8/2000 | Kishimoto | G04C 3/001 219/720 |
| 6,173,710 | B1 | 1/2001 | Gibson et al. | |
| 6,341,601 | B1 | 1/2002 | Ward et al. | |
| 6,864,472 | B2 | 3/2005 | Kang | |
| 6,899,095 | B2 * | 5/2005 | Livchak | F15D 1/02 126/299 D |
| 6,932,443 | B1 | 8/2005 | Kaplan et al. | |
| 7,049,568 | B2 | 5/2006 | Jeong | |
| 2002/0023637 | A1 | 2/2002 | Okamoto et al. | |
| 2002/0134371 | A1 | 9/2002 | Ward et al. | |
| 2003/0109211 | A1 | 6/2003 | Bastian | |
| 2006/0286917 | A1 | 12/2006 | Dionne | |
| 2008/0091681 | A1 * | 4/2008 | Dwivedi | G06F 21/554 |
| 2008/0135041 | A1 * | 6/2008 | Robison | F24C 15/2057 126/299 D |
| 2008/0308088 | A1 | 12/2008 | Livchak et al. | |
| 2009/0061752 | A1 | 3/2009 | Burdett et al. | |
| 2009/0178662 | A1 | 7/2009 | Deng | |
| 2009/0183728 | A1 | 7/2009 | Kolecki | |
| 2011/0269085 | A1 | 11/2011 | Wiker et al. | |

FOREIGN PATENT DOCUMENTS

| | | | |
|---|---|---|---|
| DE | 1932824 | U | 2/1966 |
| DE | 3603028 | A1 | 8/1987 |
| DE | 29919452 | U1 | 1/2000 |
| EP | 0085178 | A1 | 8/1983 |
| EP | 1120607 | A2 | 8/2001 |
| EP | 1122500 | A2 | 8/2001 |
| EP | 1624254 | A1 | 2/2006 |
| EP | 1707884 | A2 | 10/2006 |
| EP | 1729065 | A1 | 12/2006 |
| FR | 2519121 | A | 7/1983 |
| JP | 0602660 | | 2/1994 |
| JP | 2003050033 | A | 2/2003 |
| JP | 2006317125 | A | 11/2006 |
| JP | 2009156514 | A | 7/2009 |
| WO | 9103330 | A1 | 3/1991 |
| WO | 2006012628 | A2 | 2/2006 |
| WO | 2006074420 | A2 | 7/2006 |
| WO | 2008065332 | A2 | 6/2008 |
| WO | 2009092077 | A1 | 7/2009 |

OTHER PUBLICATIONS

Clark, Solving Kitchen Ventilation Problems, ASHRAE Journal, Jul. 2009, pp. 20-24.

Communication pursuant to Rules 70(2) and 70a(2) EPC for EP 11733387.2 dated Oct. 23, 2014.

Examination Report issued in IN Application No. 6308/DELNP/2012 dated Nov. 28, 2018.

Extended European Search Report for European Application No. 11733387.2 dated Oct. 6, 2014.

Extended European Search Report issued in European Patent Application No. 16172404 dated Jan. 31, 2017.

International Search Report and Written Opinion for International Application No. PCT/US2011/021167 dated Jun. 16, 2011.

Japanese Patent Application No. 2012-549085 Office Action dated Jul. 28, 2015 with English translation.

Mexican Office Action for Patent Application No. MX/a/2012/008043 dated Jul. 30, 2014.

Mexican Patent Application No. MX/a/2012/008043 Office Action dated May 18, 2015.

Notice of Reasons for Refusal dated Nov. 11, 2014 in JP Patent Application No. 2012-549085.

Office Action for Canadian Patent Application No. 2786557 dated Nov. 4, 2016.

Office Action for Chinese Patent Application No. 201610371276.X dated Jun. 28, 2018 (with machine translation).

Office Action for Chinese Patent Application No. 201610371276.X dated Oct. 27, 2017 (with machine translation).

Office Action dated Apr. 1, 2015 in Chinese Patent Application No. 201180006171.X.

Office Action dated Aug. 5, 2014 in Chinese Patent Application No. 201180006171.X.

Partial European Search Report issued in European Patent Application No. 16172404 dated Aug. 30, 2016.

Preliminary Office Action dated Jan. 21, 2020 for Brazilian Patent Application No. 112012017392.8.

Office Action (Communication Pursuant to Article 71(3) EPC) dated Nov. 5, 2019 for European Patent Application No. 16172404.2.

* cited by examiner

OVEN EXHAUST HOOD METHODS, DEVICES, AND SYSTEMS

CROSS-REFERENCE TO RELATED APPLICATIONS

This application is a continuation application of U.S. patent application Ser. No. 15/260,590 filed on Sep. 9, 2016, which is a continuation of U.S. patent application Ser. No. 14/265,966 filed on Apr. 30, 2014, now U.S. Pat. No. 9,777,929 granted on Oct. 3, 2017, which is a continuation application of U.S. patent application Ser. No. 13/761,412 filed on Feb. 7, 2013, now U.S. Pat. No. 9,134,036 granted on Sep. 15, 2015, which is a continuation of U.S. patent application Ser. No. 13/522,048 filed on Jul. 13, 2012 (now abandoned), which is a U.S. national stage filing under 35 U.S.C. § 371 of International Application No. PCT/US2011/021167 filed Jan. 13, 2011, which claims priority to and the benefit of U.S. Provisional Application No. 61/294,511, filed on Jan. 13, 2010, the content of which are incorporated herein by reference in their entireties.

BACKGROUND

Exhaust systems for ovens are known. Such systems include an exhaust intake, for example an exhaust hood, that may include a cleanable cartridge filter. Basic exhaust hoods use an exhaust blower to create a negative pressure zone to draw effluent-laden air directly away from the pollutant source. In kitchen hoods, the exhaust blower generally draws pollutants, including room-air, through a filter and out of the kitchen through a duct system. An exhaust blower, e.g., a variable speed fan, contained within the exhaust hood is used to remove the effluent from the room and is typically positioned on the suction side of a filter disposed between the pollutant source and the blower. Depending on the rate by which the effluent is created and the buildup of effluent near the pollutant source, the speed of exhaust blower may be manually set to minimize the flow rate at the lowest point which achieves capture and containment.

Hoods employ recesses to act as buffers to match the flow of variable fumes to the constant rate of the exhaust system. The exhaust rate required to achieve full capture and containment is governed by the highest transient load pulses that occur. This requires the exhaust rate to be higher than the average volume of effluent (which is inevitably mixed with entrained air). Ideally the oversupply of exhaust should be minimized to avoid wasting energy. Hoods work by temporarily capturing bursts of effluent, which rise into the hood due to thermal convection and then, giving the moderate average exhaust rate time to catch up.

One problem with the buffer model is that the external environment may displace fumes and thereby add an excess burden of ambient air into the exhaust stream. This results in fumes being injected into the occupied space surrounding the hood. These transients are an on-going problem for hood design and installation. Recesses in a hood provide a buffer zone above the pollutant source where buoyancy-driven momentum transients can be dissipated before pollutants are extracted. By managing transients in this way, the effective capture zone of an exhaust supply can be increased.

U.S. Pat. No. 4,066,064 shows a backshelf hood with an exhaust intake located at a position that is displaced from a back end thereof. A short sloping portion rises and extends at a shallow angle toward the inlet from the back end of the hood recess.

U.S. Pat. No. 3,941,039 shows a backshelf hood with side skirts and sloping wall from a rear part of the hood to an inlet located near the middle of the hood. The front of the hood has a horizontal portion (baffle) that extends between about 15 percent and about 20 percent of the front to back dimension of the hood. This part is claimed to direct air in a space above the baffle toward the exhaust inlet and to direct air that is drawn from the ambient space in a horizontal direction thereby encouraging rising fumes to be deflected toward the exhaust inlet.

SUMMARY

According to embodiments, the disclosed subject matter includes a method for containing effluent from one or more ovens, comprising: positioning one or more ovens in a cabinet and surrounding the one or more ovens with a cabinet suction zone generated by a continuous space therein that opens, at oven face inlets toward a forward face of the cabinets coinciding with a forward face of the one or more ovens, positioning a forward overhanging hood portion and creating a perimeter suction zone along a perimeter of the forward overhanging hood portion, the forward overhanging hood portion having a depth of at least 12 inches and the suction zone having forward and side aspects, the forward overhanging hood portion being contiguous and connected to the cabinet and the perimeter and cabinet suction zones being created by a negative pressure in the continuous space in communication between the hood portion and the cabinet, the continuous space being in communication with an exhaust connection connected to an exhaust fan to generate the negative pressure, the oven face inlets defining at least one side inlet and at top inlet immediately adjacent to each of the one or more ovens on a non-hinge side of the one or more ovens, collecting fumes emitted by opening the door of the one or more ovens through the oven face inlets and the perimeter suction zone and exhausting them through the exhaust connection.

In this method, the collecting may include controlling the flow of exhaust by means of a fan controller or a damper responsively to a state of one or more of the one or more ovens. The cabinet may have a generally constant cross-section and the hood portion is larger than the cabinet on three sides defining two opposing lateral overhanging portions and the one forward overhanging portion. The forward overhanging portion may be deeper than either of the lateral overhanging portions. The hood portion may have at least one curtain jet directed downwardly. The fumes may be directed by a baffle plate along a lower surface of the hood portion toward a vertical inlet register and into the continuous space. The baffle plate may be lower toward a forward side of the hood portion and higher toward a rearward side of the hood portion. The oven face inlets may have adjustable widths. The oven face inlets may each form an L-shape and include a horizontal portion and a vertical portion. The one or more ovens may be two ovens.

According to embodiments, the disclosed subject matter includes an exhaust device, with a cabinet defining a cabinet plenum that opens to front facing inlet registers on a forward face of the cabinet, the cabinet having support bays that open at the forward face of the cabinet at respective support bay openings, a hood portion at a top of the cabinet having a hood plenum in communication with the cabinet plenum, the cabinet and hood plenums being communication with an exhaust outlet having a filter, the hood portion having a front overhang that is at least 20 percent of the depth of the cabinet and overhanging the forward face of the cabinet, the front overhang defining a recess that overlies the front of the cabinet and is fluid communication with the hood plenum, the front facing inlet registers including a horizontal register and a first vertical register immediately adjacent each of the support bay openings. The front overhang may have a depth of at least 12 inches. The recess may have a baffle plate at a blind end thereof that is pitched to guide fumes toward a top of the cabinet and into an inlet open to the hood plenum. The front facing registers may form an L-shaped opening. The device may include a second vertical register adjacent each of the support bay openings and opposite the first vertical register. The first vertical register may be larger than the second vertical register. The support bays may be two support bays including lower and upper support bays, the horizontal register adjacent the bottom support bay being larger in area than the horizontal register adjacent the upper support bay. The vertical and horizontal registers may have adjustable widths.

According to embodiments, the disclosed subject matter includes an exhaust device, with an exhaust hood portion with recess and an interior surface of the recess, a baffle plate supported below a blind end of the recess to define a gap between the edge of the baffle plate and a descending inner surface of the recess, an exhaust inlet opening to a plenum space between the blind end and the baffle plate, the baffle plate being movable to provide access to the inlet, the gap circumnavigating at least three sides of the hood portion.

The gap may circumnavigate four sides of the hood portion to form a full perimeter inlet. According to embodiments, the disclosed subject matter includes a method of controlling exhaust flow, comprising receiving at a digital controller at least one signal pertaining to a state of an oven, controlling an exhaust flow to increase responsively to the at least one signal at a first time, controlling the exhaust flow to decrease at a later time responsively to at least another signal indicating that a door of the oven has been closed. The at least one signal may include an image signal. The at least one signal may include a data signal from the oven. The at least one signal may include a signal from a proximity sensor. The at least another signal may include an image signal. The at least another signal may include a data signal from the oven. The at least another signal may include a signal from a proximity sensor. The controlling may include regulating both a fan speed and a damper in coordination. Either controlling may include making a probabilistic estimation of a door opening or closing event.

DETAILED DESCRIPTION OF THE DRAWINGS

Figure 1:
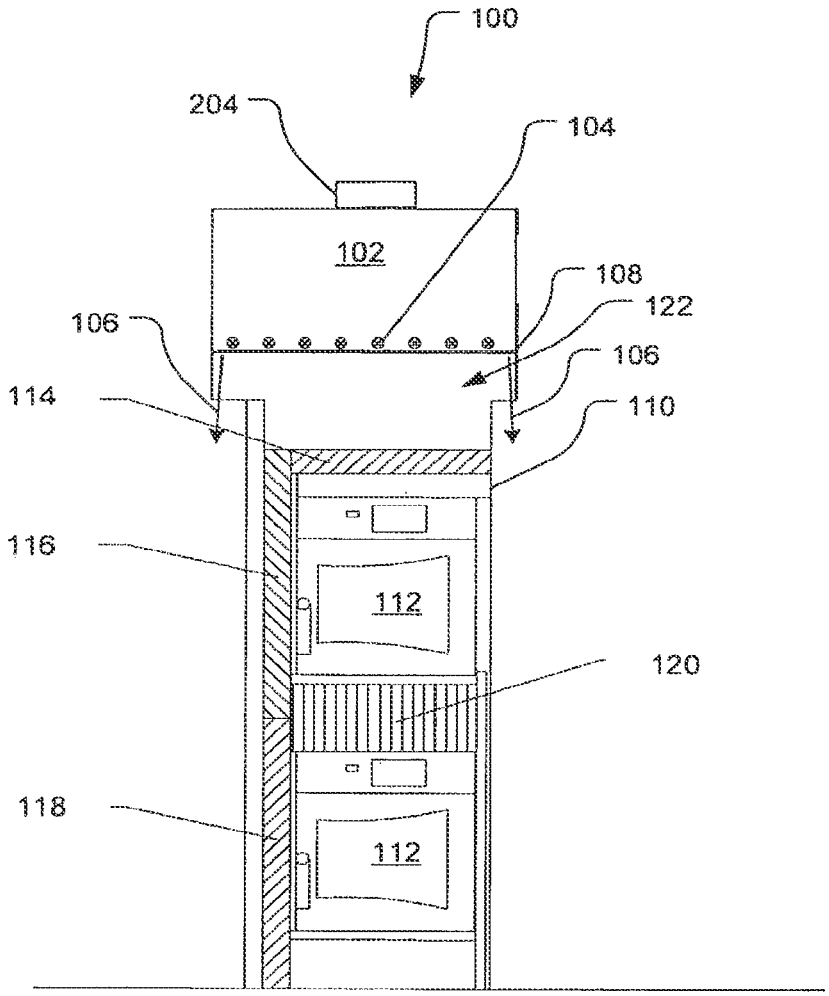
FIG. 1 is a front elevation of an exhaust appliance configured to exhaust effluent from a pair of ovens, for example, convection ovens or combi (combination steam/convection) ovens according to embodiments of the disclosed subject matter.
Figure 2:
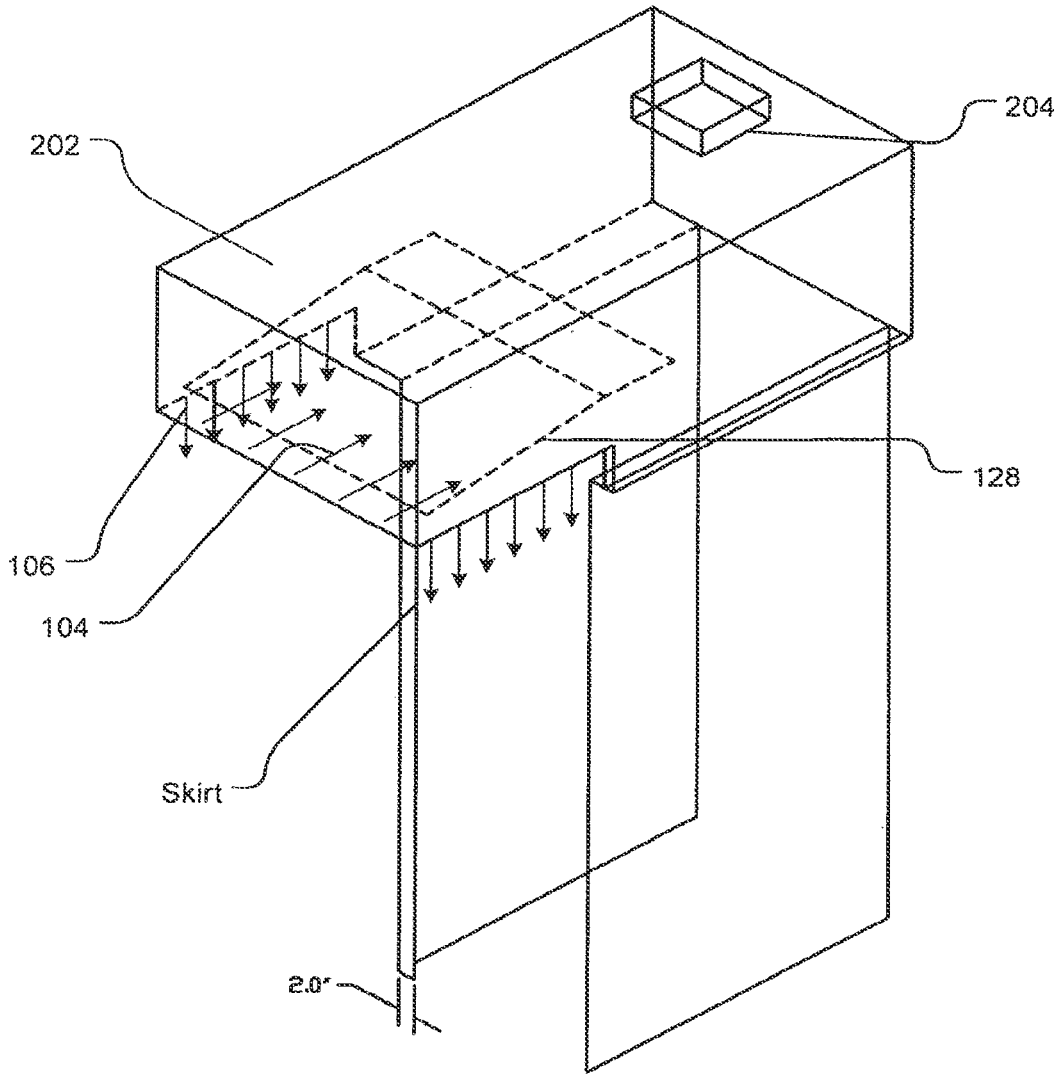
FIG. 2 is a partial ghost oblique view of an exhaust appliance configured to exhaust effluent from a pair of ovens, for example, convection ovens or combi (combination steam/convection) ovens according to embodiments of the disclosed subject matter.

An exhaust hood for use over multiple ovens may be configured to capture the cooking effluent and smoke from the ovens and particularly when the oven is accessed by opening it. Shown in a vertical stack configuration in FIGS. 1-5 is a cabinet with shelves for ovens (1, 2 or more) with vertical and horizontal inlets that surround each oven on all sides. One inlet is located at the top to vent the recess of a hood that overhangs the column of ovens. The hood portion has vertical and horizontal jets which may be as shown. Fumes are sucked into an exhaust system and blown through a treatment system or disposed of in any suitable way. The system may also capture the heat and/or steam which may be generated by such ovens. The inlets may be larger on the sides of the ovens located remote from the oven hinge since that is the part of the oven from which most of the fumes escape when the oven door is opened. The hood can have wider overhangs on the side of the oven that is remote from the hinge as well.

The total exhaust air flow driver behind the exhaust airflow may be controlled to be a function of how the ovens are being operated at any given point in time. For a single oven, the airflows may be a function of the single oven operating state which is either off, idle, and cooking where the door is considered to be either opened or closed. Although there can exist a state in idle where an operator can open a door, this typically would not result in effluent or smoke being emitted by the oven, only heat and/or moisture, since no cooking is taking place.

With regard to the level of exhaust airflow for a single oven no airflow would be required if the oven were turned off. During idle (e.g., standby) operation, the oven would be consuming energy required to maintain the oven thermostat setpoint—under this condition a lowest exhaust airflow is used to capture the heat and/or moisture from the oven. During cooking with the oven door closed the energy input into the appliance increases to heat the food and maintain the oven temperature and in the case of a convection oven additional energy is provided to drive an air circulation fan. In this cooking condition, the oven may be venting grease and smoke from the cooking process in addition to heat and moisture. This state may be provided with a higher exhaust airflow than when the oven is in the idle state. The condition with the highest amount of effluent being discharged is during cooking or at the end of the cook cycle when the oven door is opened—in this case heat, smoke, moisture and grease effluent is not only being vented from the oven vent but is physically induced out of the oven from the act of opening the door. This condition can require several times the exhaust airflow to capture compared to the cooking state with the oven doors closed. Therefore for a single oven there are five possible control states that can exist for the oven: off, idle with door closed, idle with door open, cooking with door closed, and cooking with the door open although the idle state with the door open is not typically experienced except when the oven is being loaded with food. Exhaust can be ramped up in response to a proximity sensor that detects a person about to open an oven door.

When two ovens are stacked upon each other there are potentially ten possible control states all of which could have different exhaust airflows for proper capture of the effluent, heat, smoke and moisture from the ovens. However with double-stacked ovens the bottom oven will have a significantly higher exhaust airflow compared to the upper oven for any of the five oven control states. This difference in airflows, required between the lower and upper ovens, is predominantly a function of the increased distance between the oven and the suction device.

With regard to the specific control mechanisms which could be used to monitor the oven state, the most direct approach would be to get a signal directly from the oven which indicated its operating state. The off operating state may have to be inferred from the absence of an oven signal. Other possible control feedback devices could include having a current switch installed on the circulation fan of a convection oven which detects when the fan is turned on—this device could differentiate between cooking and idle depending upon the control scheme of the oven. For a combi-oven (or another oven which introduces moisture into the cavity) a humidity sensor located at the oven vent or in the exhaust plenum of the hood may detect when the oven is operating. For a dry (convection) oven, a thermostat may be able to determine on average when the oven is in the cooking versus idle state.

Depending upon the cooking processes, an optical smoke sensor may be utilized if sufficient quantities of smoke are produced during cooking.

Referring to FIGS. 1 to 5, an exhaust appliance 100 has a hood portion 102 that generates horizontal jets (figuratively shown as circles with Xs at 104 directed into the page) and vertical jets 106 along a perimeter 108 thereof. In alternative embodiments, the hood portion 102 may also have only vertical jets or only horizontal jets as well.

A cabinet 110 surrounds ovens 112 defining a shelf 1 top inlet 114, and shelf 2 top inlet 120 and first 116 and second 118 side inlets for respective first and second shelves. In an alternative embodiment the shelf 1 top inlet 114 is omitted and in the illustrated embodiment, the shelf 2 top inlet 120 is larger than the shelf 2 top inlet 114. In yet another alternative embodiment, the top inlets 114 and 120 are the same size. A hood inlet 122 is located beneath a baffle plate 128.

The ovens 112 are, for example, convection ovens, microwaves or combinations thereof, steam—convection combination ovens or conventional ovens. In embodiments the ovens can be replaced by other sources of effluent such as chain grills, laboratory cabinets, or other devices that emit fumes. In particular embodiments, the devices emit pulses of fumes or fumes emanate more strongly on one side than the other as to side opening "door" ovens. The ovens 112 illustrated have hinges on the right and open from the left but could open on either side. In embodiments, the suction of all inlets produces a face velocity of 10-60 cfm per linear ft at the faces shown in diagonal shading.

Figure 3:
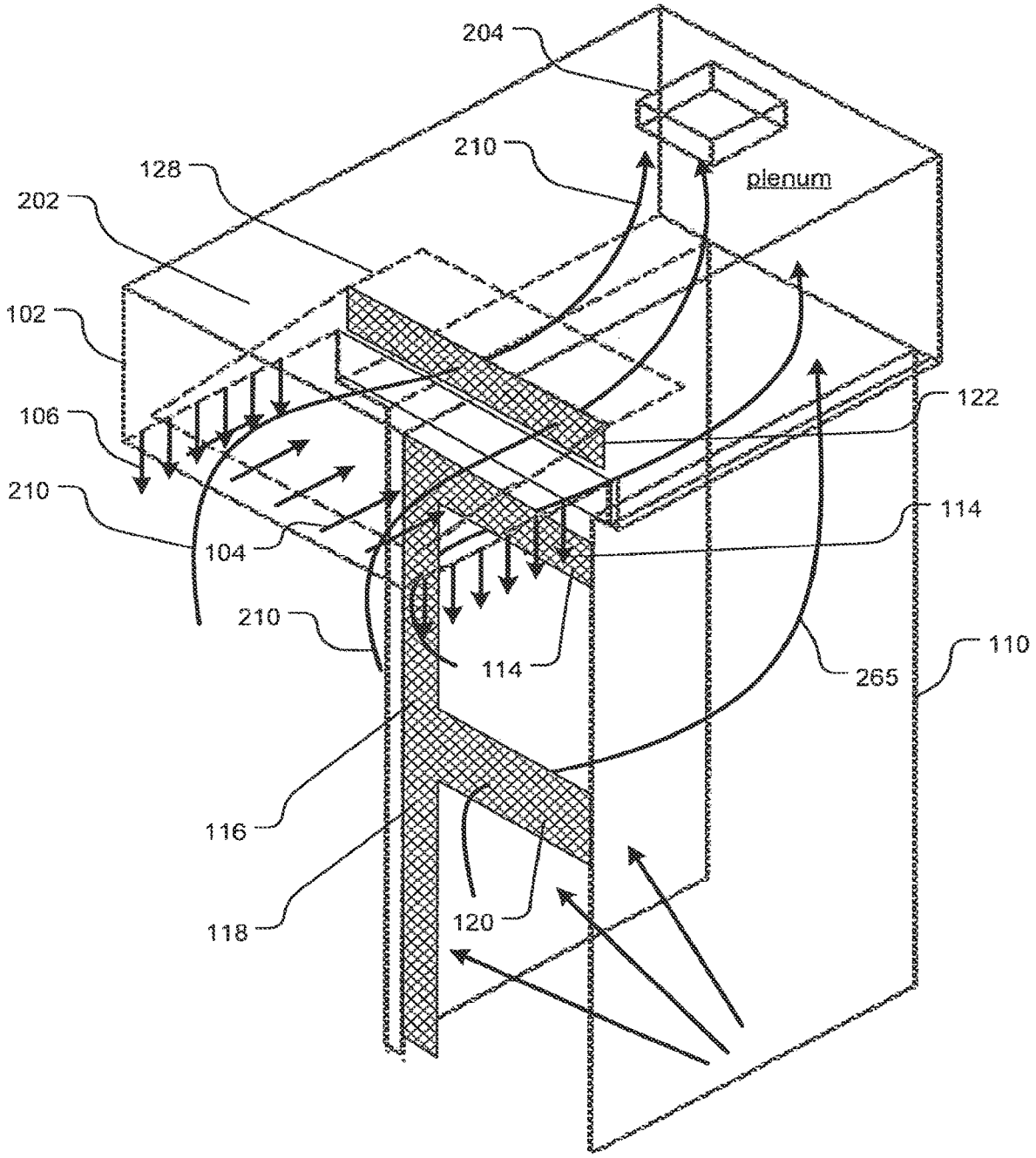
FIG. 3 is a ghost oblique view of the exhaust appliance of FIG. 2 showing flow features according to embodiments of the disclosed subject matter.

As may be seen best in FIG. 3, air is drawn through a suction plenum 202 and out through an exhaust collar 204 as indicated by the serpentine arrows 210. The exhaust collar 204 may be connected to an exhaust system (not shown). The hood portion 102 has a double wall (with a plenum 442 between the double walls shown in FIG. 5) around front perimeter to define a plenum 442 for distributing air flow that forms the vertical and horizontal jets. As can also be seen clearly in FIG. 3, air is drawn through the side and top inlets 114, 116, 118, and 120 through the cabinet 110 as indicated by the arrow 265. Fumes captured by hood portion 102 flow up into the baffle plate 128 and into horizontal inlet. In the present embodiment, the baffle plate 128 has no gaps around its perimeter and all fumes and air are drawn through the inlet area 122. In an alternative embodiment, the inlet area 122 is omitted and a gap is formed around three sides of the baffle plate 128 to form a U-shaped channel through which air is drawn up into the suction plenum behind the hood portion 102.

Figure 4:
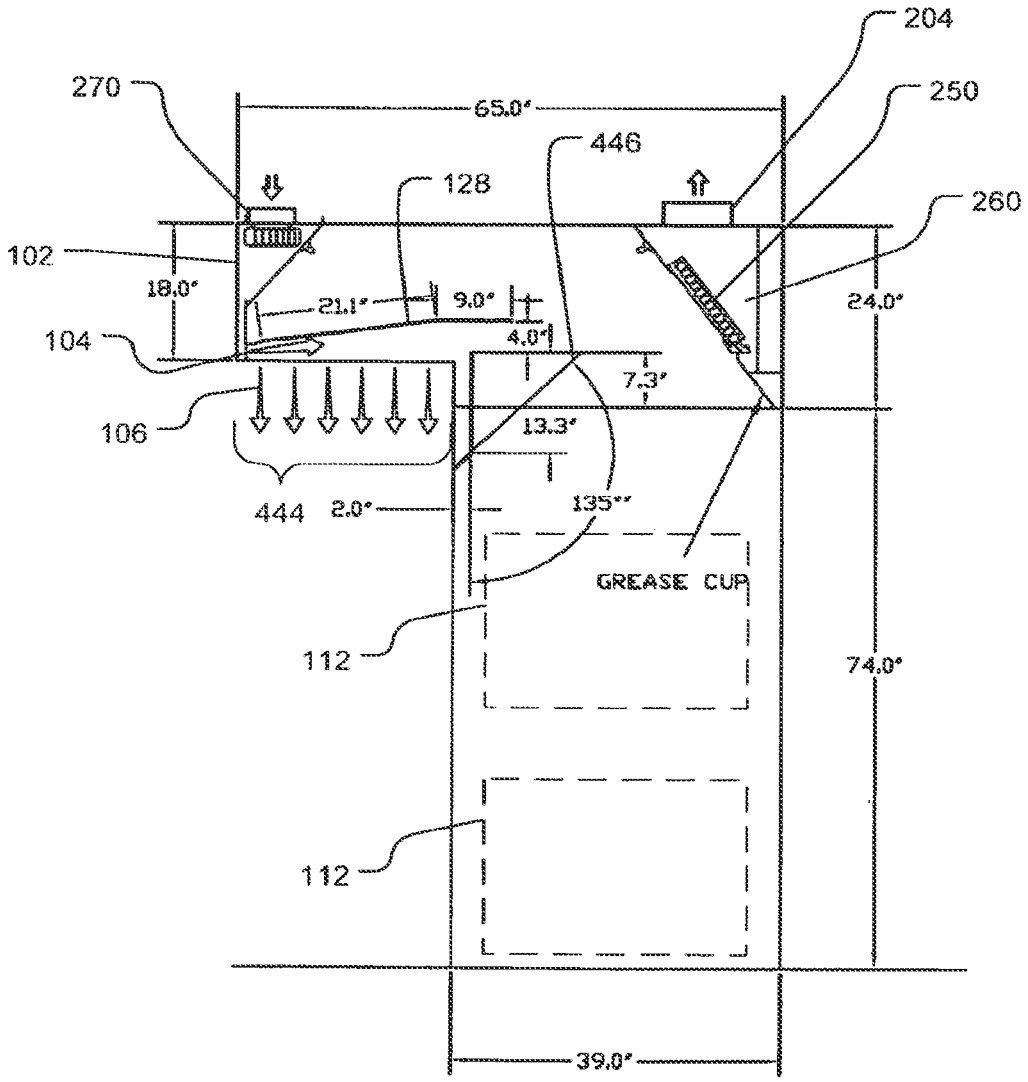
FIG. 4 is a partial ghost side view of an exhaust appliance configured to exhaust effluent from a pair of ovens, for example, convection ovens or combi (combination steam/convection) ovens according to embodiments of the disclosed subject matter.
Figure 5:
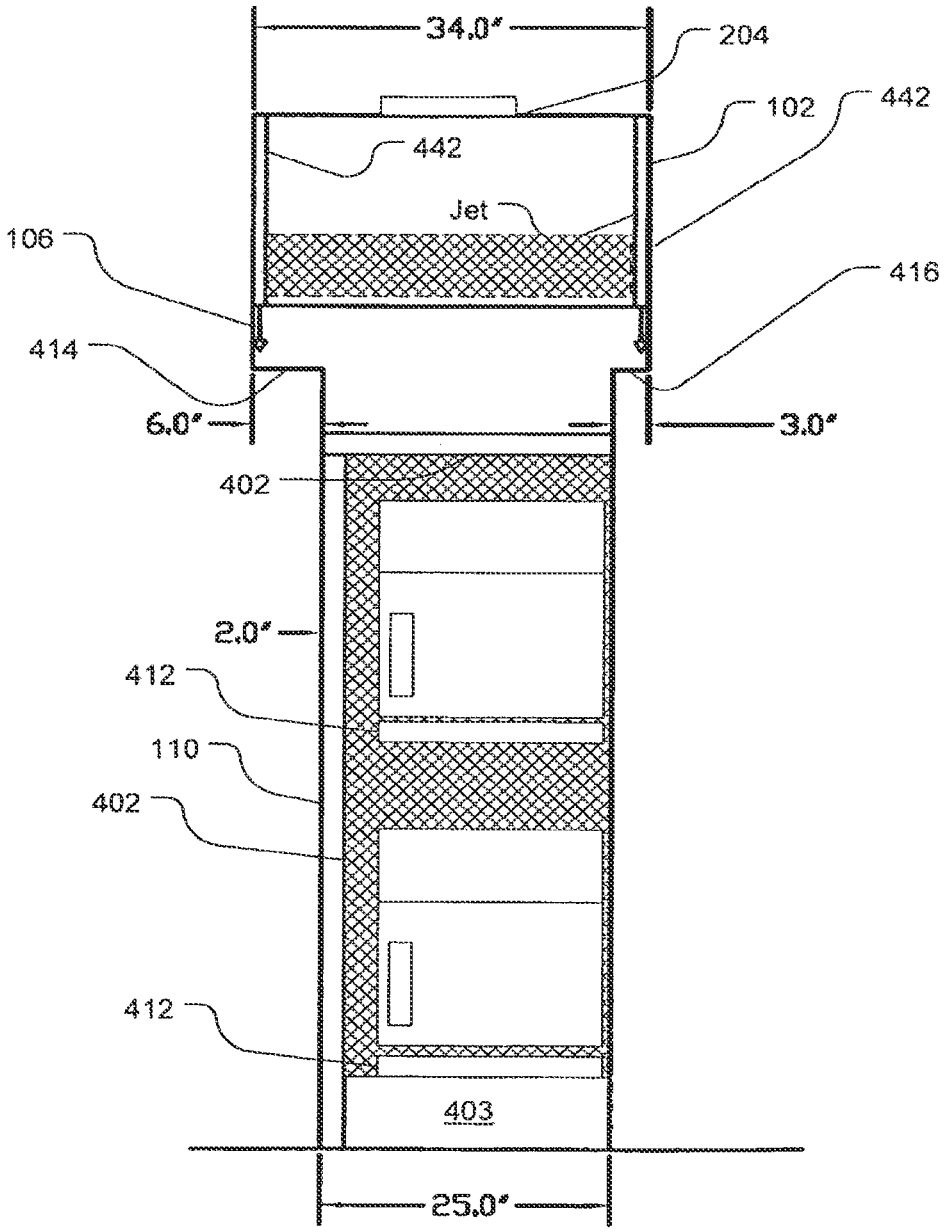
FIG. 5 is a front elevation of an exhaust appliance configured to exhaust effluent from a pair of ovens, for example, convection ovens or combi (combination steam/convection) ovens showing flow features according to embodiments of the disclosed subject matter.

As illustrated in FIG. 4, a filter 250 at an inlet of a filter plenum 260 may be provided to cause air and fumes to flow through the filter 250 before leaving through the exhaust collar 204. A fan 270 may be provided to pressurize a space between double walls forming a forward portion of the hood portion 102 to generate jets 104 and/or 106 if present.

Figure 6:
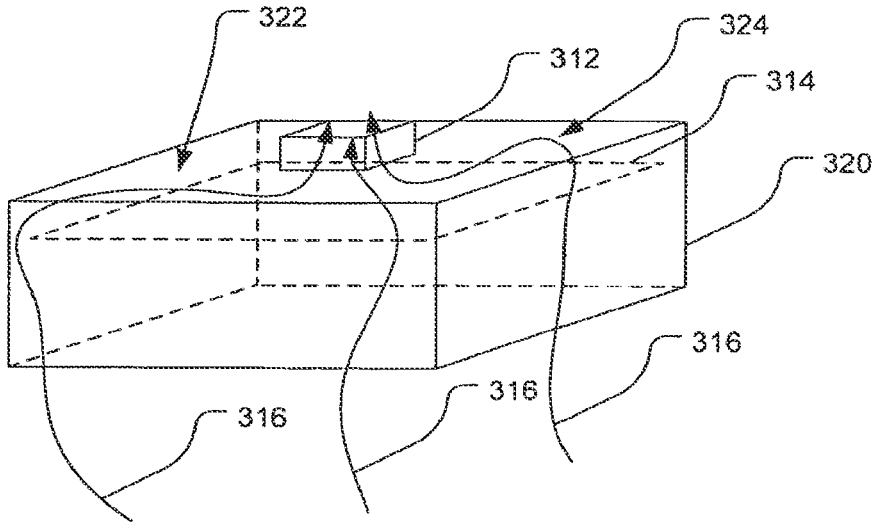
FIG. 6 illustrates a canopy hood with a perimeter inlet according to embodiments of the disclosed subject matter.

The hood configuration with perimeter inlets (embodiment where the inlet area 122 is omitted and a gap is formed around three sides of the baffle plate 128) may be used in other configurations for example a canopy or backshelf hood. In such embodiments, the perimeter may encircle a canopy hood rather than being on just three sides. For example, as shown in FIG. 6, a canopy hood has a baffle plate 314 that defines a flow gap 322 between the edge of the baffle plate 314 and an internal surface of the hood portion 320. The baffle plate 314 also defines a plenum space 324 between the baffle plate 314 and the internal surface of the hood portion 320. Arrows 316 figuratively indicate the flow of air from below the hood into the perimeter inlet defined by the flow gap 322 through the plenum 324 and out the exhaust collar 312. A variation of the embodiment of FIG. 6 for a backshelf hood would have a flow gap 322 on three sides of the hood 320 rather than four. Still other variants would have two flow gaps on adjacent sides meeting at a corner or on opposite sides. The features of FIG. 6 may be variously combined with any of the embodiments disclosed herein.

Blanks 402 may be used to define the sizes and shapes of the inlets 114, 116, 118, and 120. A kit of variable sized blanks may be provided to adjust for different sized ovens or the blanks may be variable sized shutters. Alternatively the adjacent inlets 114 to 118 may have adjustable flow areas such as provided by adjustable inlet louvers. These may be used to regulate the flow or adjust the size of the gap. The inlet areas may also be simply open areas. Inlet areas may also be defined below the ovens for example by a further blank as indicated at 403. The latter may also be adjustable as discussed.

The cabinet 110 may include adjustable shelves 412. The hood portion 102 may be sized to provide overhangs which are wider on a side 414 where the ovens open than on the oven hinge side 416. An air guide 446 (FIG. 4) may be provided in embodiments to direct the flow of fumes and air toward the filter 250 inlet. The air guide may be omitted in embodiments.

In embodiments, the lateral overhangs 414 and 416 are between 5 and 30 percent of the overall width of the hood portion 102. In embodiments the front overhang may be between 20 percent and 50 percent of the overall depth of the hood portion 102. In embodiments, the front overhang 444 is 30-40 percent of the depth of the hood portion. In embodiments, the overhang 444 is 18 to 30 inches.

Figure 7:
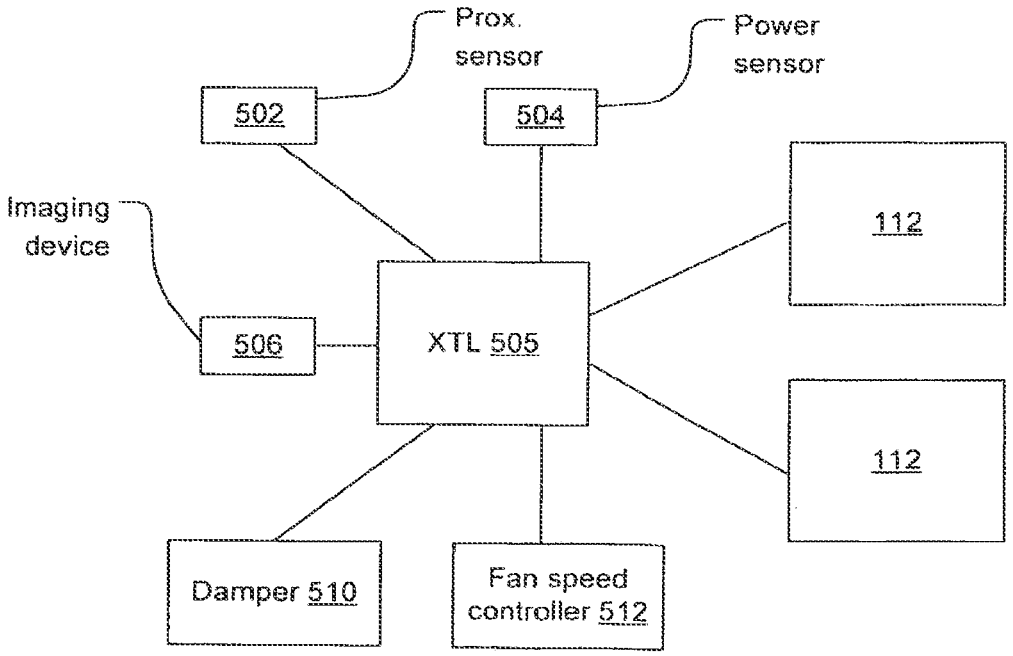
FIG. 7 shows a control system that may be used with any of the embodiments of the disclosed subject matter.

FIG. 7 shows a control system that may be used with any of the embodiments of the disclosed subject matter. A controller 505 may provide control to one or more of a damper 510 and a fan speed controller 512 or other flow regulation device (not shown). The controller 505 may receive signals (digital message, analog signals, etc.) from ovens 112, one or more power sensors 504 that receives indication or power consumption by ovens 112, one or more proximity sensors 502 located to detect the presence of a person approaching an oven 112, and/or one or more imaging devices 506 located to detect the presence of a person approaching an oven 112. The signals from the ovens may provide state information such as the amount of time left on a timer indicating remaining time till shutoff. The one or more dampers 510 may correspond to a single damper positioned to control the flow of air through the exhaust collar.

What is claimed is:

1. A method of controlling exhaust flow, comprising:

providing an exhaust hood with a controllable exhaust flow rate;

receiving at a digital controller of the exhaust hood at least one signal pertaining to a state of a cooking appliance that has at least one door;

controlling the controllable exhaust flow rate to increase responsively to the at least one signal at a first time;

controlling the controllable exhaust flow rate to decrease at a second time, later than the first time, responsively to at least another signal indicating that the at least one door of the cooking appliance has been closed; and exhausting fumes generated by the cooking appliance through at least one inlet of the exhaust hood, wherein the at least one inlet has an opening that is adjacent to the at least one door of the cooking appliance, the at least one door is configured to close an opening of the cooking appliance, and the opening of the cooking appliance lies in a first plane which is substantially parallel to a second plane in which the opening of the at least one inlet lies.

2. The method of claim 1, wherein the at least one signal includes an image signal.

3. The method of claim 1, wherein the at least one signal includes a data signal from the cooking appliance.

4. The method of claim 1, wherein the at least one signal includes a signal from a proximity sensor.

5. The method of claim 1, wherein the at least another signal includes an image signal.

6. The method of claim 1, wherein the at least another signal includes a data signal from the cooking appliance.

7. The method of claim 1, wherein the controlling includes regulating both a fan speed and a damper in coordination.

8. The method according to claim 1, wherein the exhausting the fumes through the at least one inlet of the exhaust hood includes exhausting the fumes through an opening of the at least one inlet which is horizontally adjacent to the at least one door of the cooking appliance.

9. The method of claim 3, wherein the data signal from the cooking appliance provides state information including an amount of time left on a timer indicating remaining time till shutoff of the cooking appliance.

10. The method of claim 3, wherein the at least another signal includes an image signal.

11. The method of claim 4, wherein the at least another signal includes a data signal from the cooking appliance.

12. The method of claim 4, wherein the at least another signal includes an image signal.

13. The method according to claim 9, wherein the at least another signal includes a signal from a proximity sensor.

14. The method according to claim 9, wherein the at least another signal includes an image signal.

* * * * *